US009810492B2

(12) United States Patent
Tomkins et al.

(10) Patent No.: US 9,810,492 B2
(45) Date of Patent: Nov. 7, 2017

(54) METHOD AND SYSTEM FOR THE IN-SITU REMOVAL OF CARBONACEOUS DEPOSITS FROM HEAT EXCHANGER TUBE BUNDLES

(71) Applicant: T5 Technologies, Inc., Edmonton (CA)

(72) Inventors: Michael Tomkins, Sherwood Park (CA); Robert Larsen, Wetaskiwin (CA)

(73) Assignee: T5 TECHNOLOGIES, INC. (CA)

( * ) Notice: Subject to any disclaimer, the term of this patent is extended or adjusted under 35 U.S.C. 154(b) by 0 days.

(21) Appl. No.: 14/190,230

(22) Filed: Feb. 26, 2014

(65) Prior Publication Data

US 2014/0238437 A1 Aug. 28, 2014

Related U.S. Application Data

(60) Provisional application No. 61/769,529, filed on Feb. 26, 2013.

(51) Int. Cl.
*B08B 3/00* (2006.01)
*F28G 9/00* (2006.01)
(Continued)

(52) U.S. Cl.
CPC ..... *F28G 9/00* (2013.01); *B08B 9/023* (2013.01); *B08B 9/0323* (2013.01); *B08B 3/00* (2013.01);
(Continued)

(58) Field of Classification Search
CPC ..... F28G 9/00; B08B 9/0323; B08B 3/00; B08B 3/02; B08B 3/04; B08B 3/14;
(Continued)

(56) References Cited

U.S. PATENT DOCUMENTS 1,832,697 A * 11/1931 Freeman ..... F28G 9/00 134/11
2,123,434 A * 7/1938 Paulson ..... C11D 7/5018 134/12
(Continued)

FOREIGN PATENT DOCUMENTS

EP 0458533 11/1991
EP 0899318 3/1999
(Continued)

OTHER PUBLICATIONS

International Search Report and Written Opinion for PCT/CA2014/050131, dated Jul. 3, 2014, 11 pages.

*Primary Examiner* — Bibi Carrillo
(74) *Attorney, Agent, or Firm* — McAndrews, Held & Malloy, Ltd.

(57) ABSTRACT

The present invention comprises a method and system for the in-situ cleaning of a heat exchanger tube bundle of carbonaceous deposits. Using the method and system, an organic solvent is brought into fluid communication with one or more heat exchanger tube bundles in a closed system. The closed system is formed at the site of operation of the heat exchanger tube bundles and without having to remove the heat exchanger tube bundles from their shells or other associated equipment. Once the closed system is formed, the organic solvent is brought to a temperature at which it is effective to remove carbonaceous deposits from the heat exchanger tube bundle and flowed through the equipment associated with the heat exchanger tube bundles so as to contact the heat exchanger tube bundles and remove carbonaceous deposits that have formed therein. In some embodiments, the spent organic solvent may be recovered, such as
(Continued)

through the removal of suspended hydrocarbons, and reused in the method and system for cleaning heat exchanger tube bundles.

14 Claims, 8 Drawing Sheets

(51) Int. Cl.

| | |
|---|---|
| ***B08B 9/032*** | (2006.01) |
| ***B08B 9/023*** | (2006.01) |
| *B08B 3/08* | (2006.01) |
| *B08B 3/02* | (2006.01) |
| *B08B 3/14* | (2006.01) |
| *B08B 9/027* | (2006.01) |
| *B08B 9/02* | (2006.01) |
| *B08B 3/04* | (2006.01) |
| *F28D 7/16* | (2006.01) |

(52) U.S. Cl.
CPC . *B08B 3/02* (2013.01); *B08B 3/04* (2013.01); *B08B 3/08* (2013.01); *B08B 3/14* (2013.01); *B08B 9/02* (2013.01); *B08B 9/027* (2013.01); *B08B 9/032* (2013.01); *F28D 7/16* (2013.01)

(58) Field of Classification Search
CPC .... B08B 3/08; B08B 9/00; B08B 9/02; B08B 9/027; B08B 9/032
USPC ..... 134/1, 22.1, 22.11, 22.12, 22.14, 22.18, 134/22.19, 169 C, 105
See application file for complete search history.

(56) References Cited

U.S. PATENT DOCUMENTS

| | | | | |
|---|---|---|---|---|
| 2,380,340 | A * | 7/1945 | Simpson | C10L 10/06 134/22.19 |
| 2,857,922 | A * | 10/1958 | Effinger | C23G 3/04 104/48 |
| 3,214,867 | A * | 11/1965 | Henning | 134/10 |
| 4,308,076 | A * | 12/1981 | Knowlton | F28G 9/00 134/10 |
| 4,807,698 | A * | 2/1989 | Kohnen et al. | 165/145 |
| 5,413,168 | A | 5/1995 | Baum | |
| 5,437,296 | A * | 8/1995 | Citino | 134/108 |
| 5,642,743 | A | 7/1997 | Ranes | |
| 6,290,778 | B1 * | 9/2001 | Zugibe | 134/1 |
| 6,644,326 | B2 * | 11/2003 | Dorton et al. | 134/22.14 |
| 6,872,263 | B1 | 3/2005 | Jansen et al. | |
| 6,893,509 | B2 | 5/2005 | Sears et al. | |
| 6,936,112 | B2 | 8/2005 | Jansen et al. | |
| 8,628,628 | B1 * | 1/2014 | Bonner et al. | 134/166 R |
| 2003/0015313 | A1 | 1/2003 | Boyce | |
| 2003/0073595 | A1 | 4/2003 | Dorton et al. | |
| 2004/0102351 | A1 | 5/2004 | Jansen et al. | |
| 2004/0238006 | A1 | 12/2004 | Sears et al. | |
| 2005/0139238 | A1 * | 6/2005 | Ferrara | 134/22.11 |
| 2005/0211274 | A1 | 9/2005 | Jansen et al. | |
| 2006/0169305 | A1 | 8/2006 | Jansen et al. | |
| 2009/0072043 | A1 * | 3/2009 | Kondratayev et al. | 239/11 |
| 2009/0320877 | A1 * | 12/2009 | Bradley et al. | 134/3 |
| 2010/0307536 | A1 | 12/2010 | Nath et al. | |
| 2012/0174948 | A1 | 7/2012 | Dorton et al. | |
| 2013/0233350 | A1 * | 9/2013 | Tomkins et al. | 134/12 |

FOREIGN PATENT DOCUMENTS

| | | |
|---|---|---|
| WO | 0132804 | 5/2001 |
| WO | 03103863 | 12/2003 |

* cited by examiner

METHOD AND SYSTEM FOR THE IN-SITU REMOVAL OF CARBONACEOUS DEPOSITS FROM HEAT EXCHANGER TUBE BUNDLES

This application claims priority to U.S. Provisional Application No. 61/769,529, filed on Feb. 26, 2013.

BACKGROUND OF THE INVENTION

Field of the Invention

The present invention relates generally to a method and system for removing carbonaceous deposits from heat exchanger tube bundles. More particularly, the present invention relates to a method and system for thoroughly and efficiently cleaning heat exchanger tube bundles without having to remove the heat exchanger tube bundle from its associated equipment.

Description of the Related Art

Heat exchanger tubes bundles are used in a process to either raise or lower the temperature of a fluid. They are heavily used in the oil and gas industry, such as by refineries, upgraders, and gas plants. During use, carbonaceous deposits including heavy oil, bitumen, and other hydrocarbons can form on the tube bundles, reducing the effectiveness of the heat exchanger and forcing the operator to consume more energy to achieve the desired degree of temperature change. Accordingly, in order to maintain an efficient operation of the heat exchanger, it is necessary to periodically clean the fouled tube bundles of hydrocarbon deposits.

Current methods for cleaning heat exchanger tube bundles require shutting down the system in which the bundles are employed, evacuating the product from the bundles (if possible), disassembling the required components, and removing each heat exchanger tube bundle from its shell for external cleaning. Because this process is time consuming, the cleaning of heat exchanger tube bundles is a significant source of lost productivity. Additionally, the periodic disassembly and handling of the heat exchanger tube bundles and other system equipment inevitably shortens their lifespan.

SUMMARY OF THE INVENTION

The present invention comprises a method and system for the in-situ cleaning of a heat exchanger tube bundle of carbonaceous deposits. The present invention thus avoids the disadvantages in having to remove a heat exchanger tube bundle from its associated equipment in order to clean it of carbonaceous deposits.

The present invention generally involves a method and system whereby an organic solvent is brought into fluid communication with a heat exchanger tube bundle, or bundle train, in a closed system. Once the closed system is created, and preferably bled of gas, the organic solvent is brought to a temperature at which it is effective to remove carbonaceous deposits from the heat exchanger tube bundle and flowed through the equipment associated with the heat exchanger tube bundle or train of bundles so as to contact the heat exchanger tube bundle and remove carbonaceous deposits that have formed therein.

Embodiments of the present invention also involve the recovery of the contaminated organic solvent. Thus, in embodiments of the present invention, a heat exchanger tube bundle may be cleaned in a way that generates a minimal environmental impact. For example, after use in the heat exchanger tube bundle cleaning process, the organic solvent may be treated and then again used in the cleaning of a heat exchanger tube bundle, thereby preventing both the release of the solvent into the environment and the need for expensive disposal measures. By selecting an organic solvent that can be cost-effectively separated from suspended hydrocarbons, embodiments of the present invention also provide a more efficient method for the cleaning of a heat exchanger tube bundle. Further, using embodiments of the present invention, hydrocarbons that are separated from the organic solvent can be collected and/or treated to provide useful products. Thus, embodiments of the present invention both lower the environmental impact of the cleaning process and create a more cost-effective process.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1A:
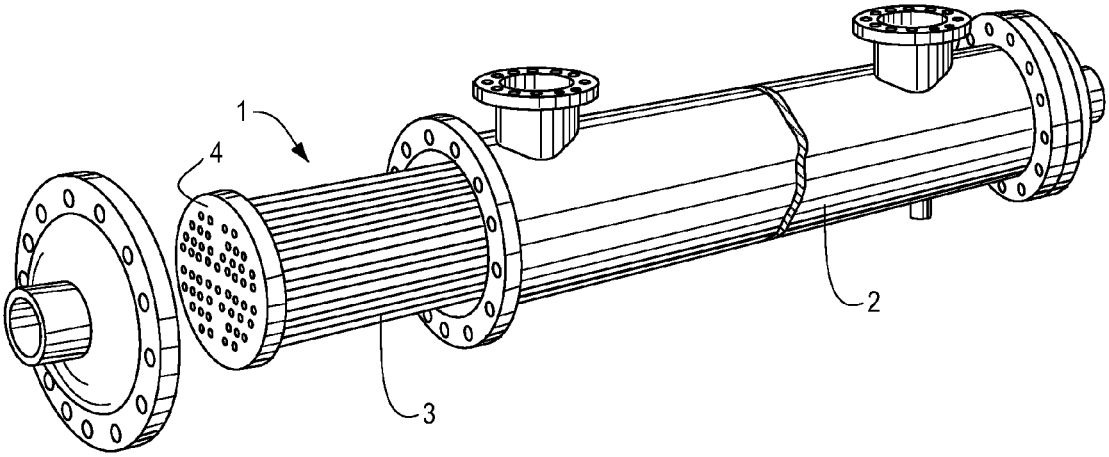
FIG. 1A is a perspective view of a heat exchanger tube bundle of the type that can be cleaned using the method and/or system of the present invention shown being removed from its shell for context only (the heat exchanger tube bundle not being removed from its shell using the method and/or system of the present invention).
Figure 1B:
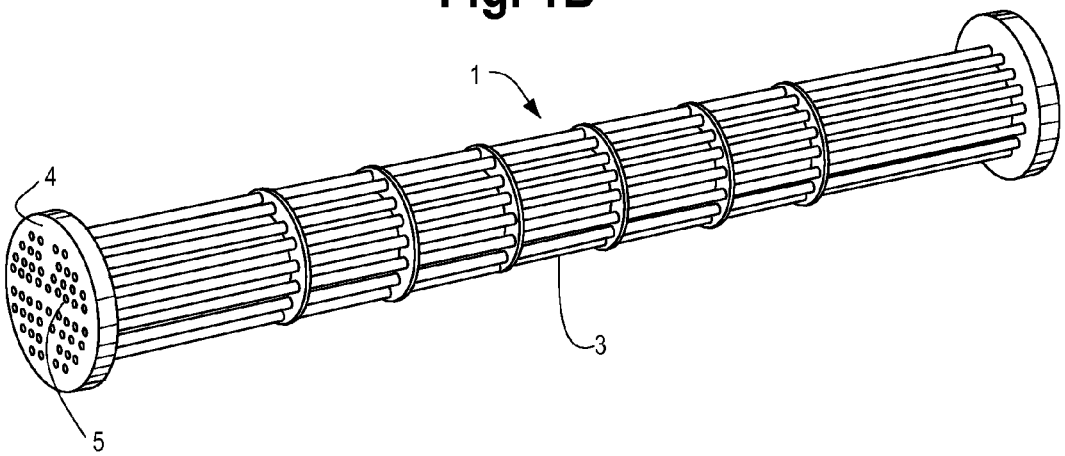
FIG. 1B is a perspective view of a heat exchanger tube bundle of the type that can be cleaned using the method and/or system of the present invention.
Figure 1C:
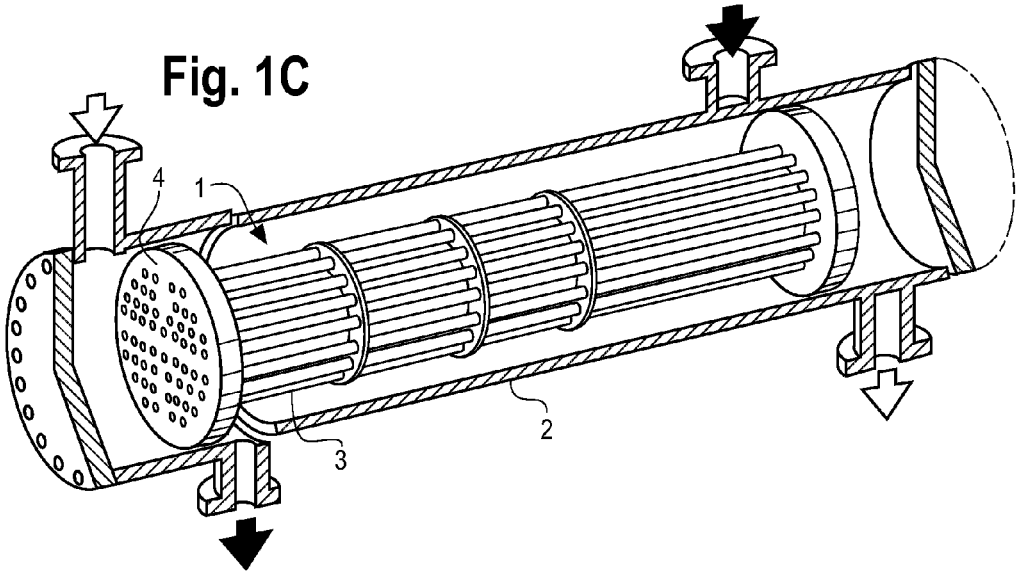
FIG. 1C is a perspective view, in section, of a heat exchanger tube bundle, including and in its shell, of the type that can be cleaned using a method and/or system of the present invention, and including an embodiment of the fluid inlets and outlets.
Figure 1D:
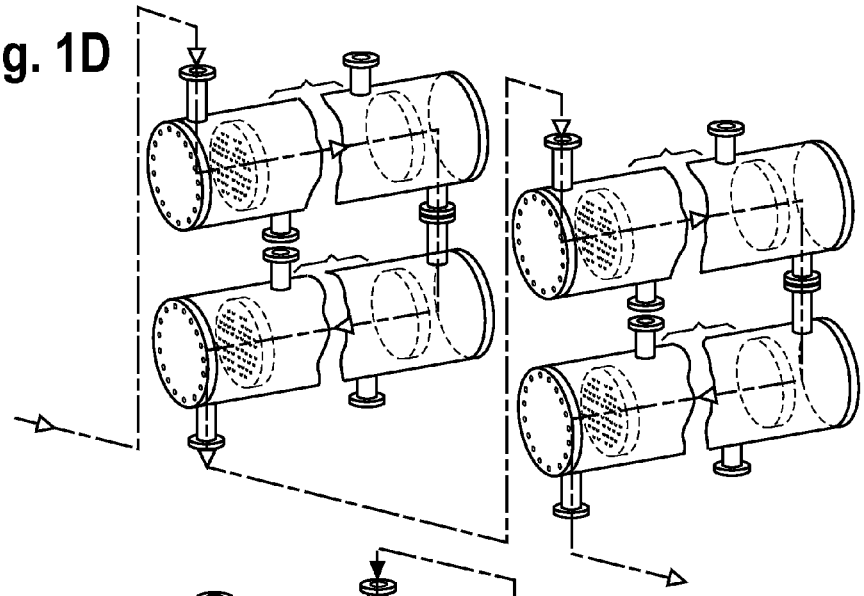
FIG. 1D is a flow diagram of an embodiment of a flow path through the tubes of heat exchanger tube bundles connected in a network sometimes referred to as a heat exchanger train.
Figure 1E:
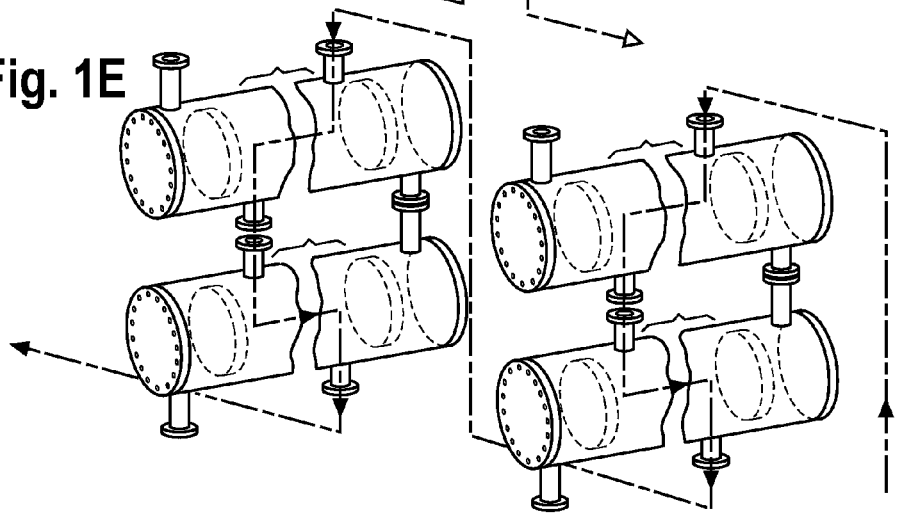
FIG. 1E is a flow diagram of an embodiment of a flow path through the shell-side of heat exchanger tube bundles connected in a network sometimes referred to as a heat exchanger train.
Figure 2:
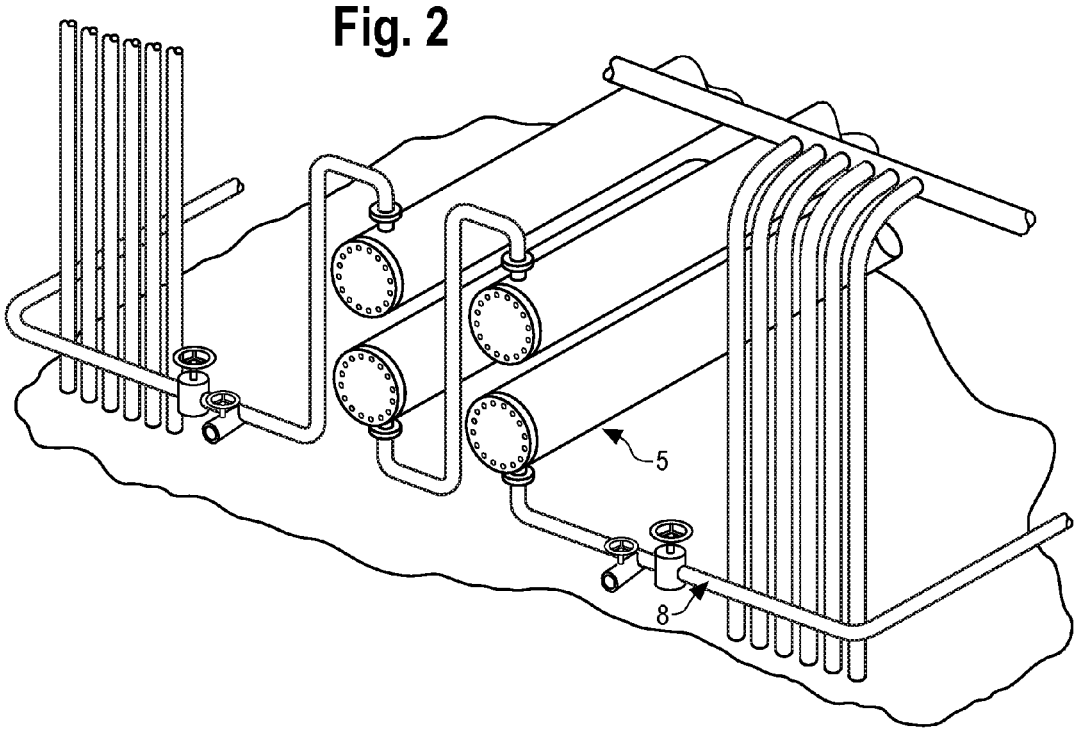
FIG. 2 is a perspective view of a network of heat exchanger tube bundles known as a heat exchanger train, and associated equipment.

A heat exchanger tube bundle of the type that may be treated by the present invention is illustrated in FIGS. 1A to 1C. A heat exchanger tube bundle 1 is made up of a large number of individual tubes packed together to form a cylindrical structure. When in use, the heat exchanger tube bundle is surrounded by a shell 2. Accordingly, a heat exchanger tube bundle 1 comprises an exterior, or shell-side, surface 3 and an interior, tube-side, surface 4. Heat exchanger bundles are often very large, typically ranging up to 84 inches in diameter and 30 feet in length. When used in certain industries, such as the gas and oil industry, a number of heat exchanger tube bundles are often used in series in a network known as a heat exchanger train 5, examples of which are illustrated in FIGS. 1D to 1E and FIG. 2.

Through the method and system of the present invention, a heat exchanger tube bundle 1 may be cleaned in-situ, that is, without being removed from the associated equipment with which it is used, including the shell 2. The method and system may also be used to clean a number of heat exchanger tube bundles, such as are present in a heat exchanger train 5, at the same time. The terms heat exchanger tube bundle and heat exchanger tube bundles will hereinafter refer to one or more than one heat exchanger tube bundle and the term heat exchanger train 5 will hereinafter refer to a unit having one or more heat exchanger tube bundles. In alternative embodiments, the method and system of the present invention may be used to clean other types of heat exchangers, such as plate exchangers, spiral tube exchangers, and the like.

In an embodiment of the method and system, a closed system 6 encompassing the heat exchanger train 5 is formed. The closed system 6 is configured such that organic solvent contained therein may be circulated to contact the heat exchanger tube bundles 1 at a temperature and pressure that are effective for the removal of carbonaceous deposits. The closed system 6 comprises at least a pump 7 in fluid communication with process equipment 8 both upstream and downstream from the heat exchanger train 5.

Figure 4A:
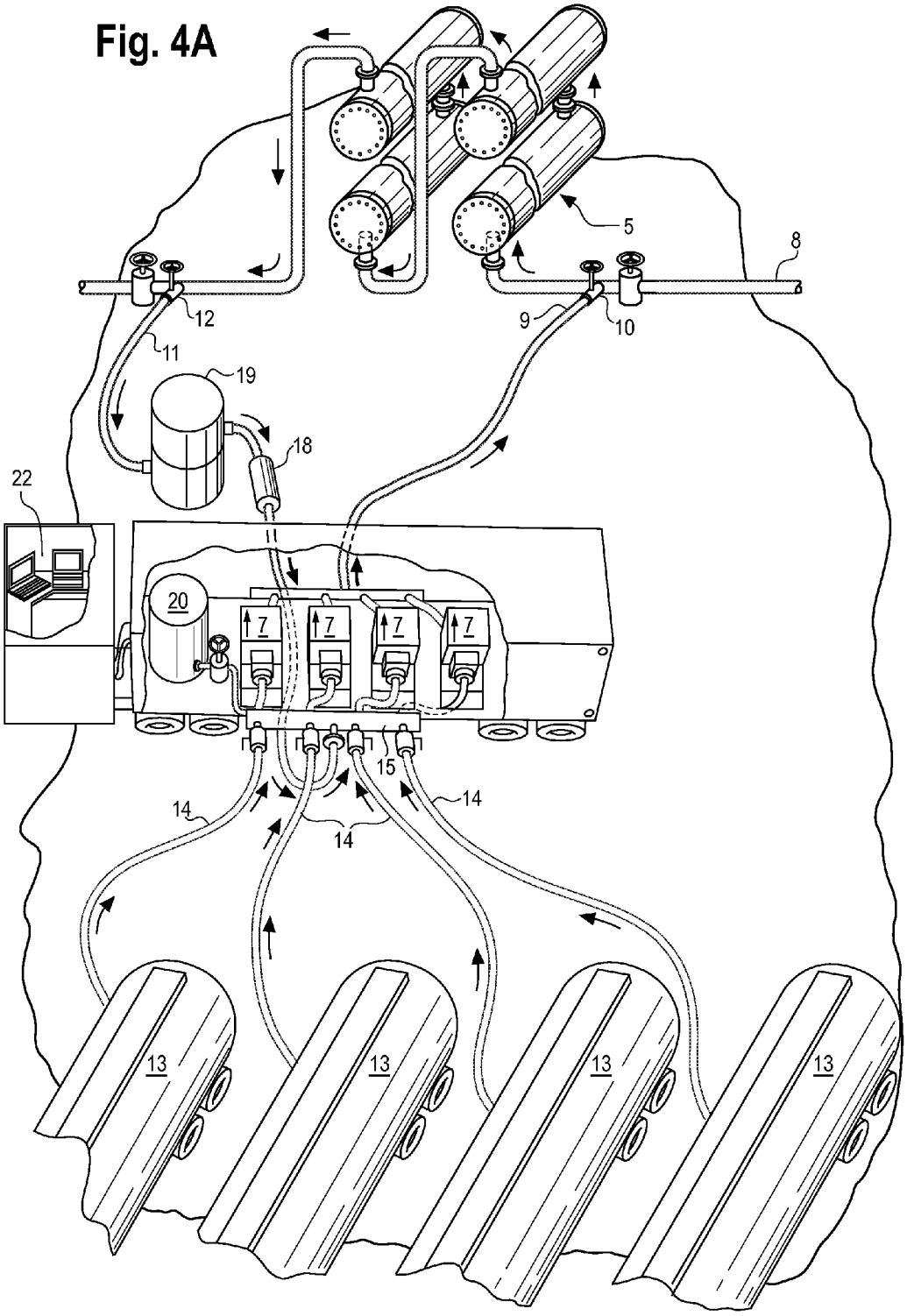
FIG. 4A is a combination flow diagram and perspective view, partly in section, of a system for the in-situ cleaning of a heat exchanger tube bundle in accordance with an embodiment of the present invention, configured for the supply of organic solvent.
Figure 4B:
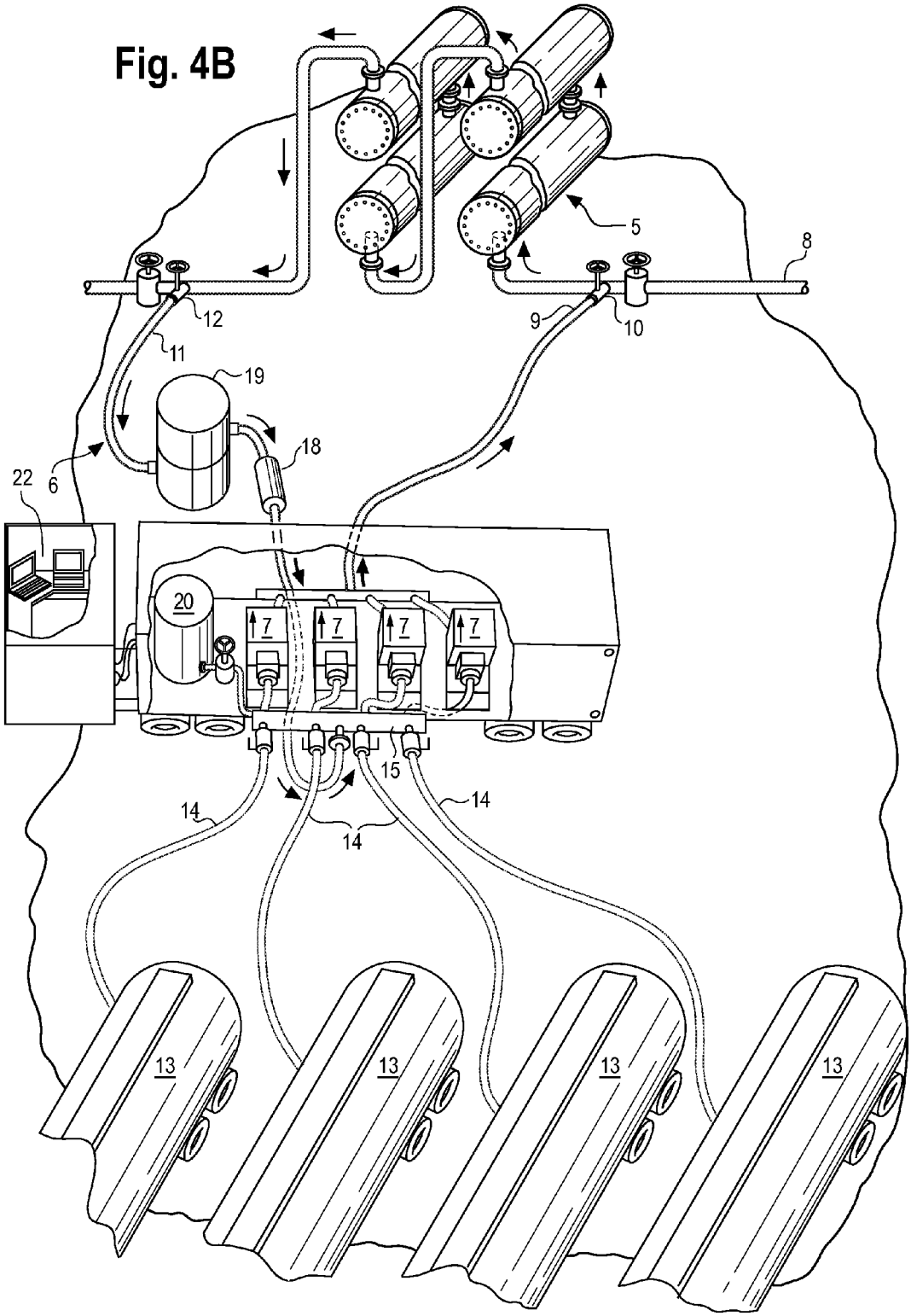
FIG. 4B is a combination flow diagram and perspective view, partly in section, of a system for the in-situ cleaning of a heat exchanger tube bundle in accordance with an embodiment of the present invention, configured for closed system flow.
Figure 5:
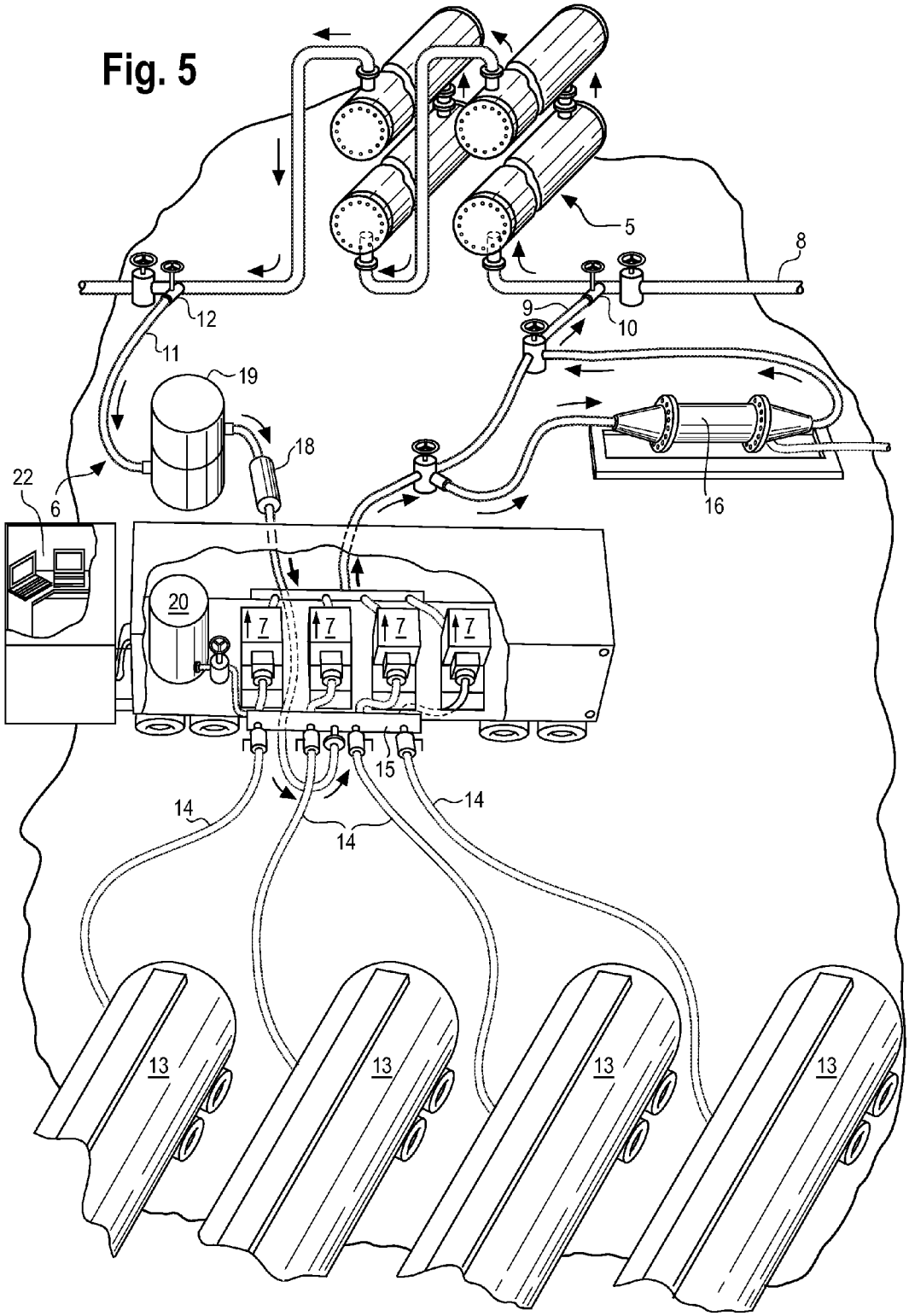
FIG. 5 is a combination flow diagram and perspective view, partly in section, of a system for the in-situ cleaning of a heat exchanger tube bundle in accordance with an embodiment of the present invention, configured for closed system flow and including a heater.

The pump 7 is configured to supply organic solvent through the heat exchanger train 5 at an operating pressure that is sufficient to remove carbonaceous deposits from the heat exchanger tube bundles 1. The pump 7 may comprise, for example, a number of high-pressure pumps, as illustrated in FIGS. 4 and 5. The number of pumps may be determined by, for instance, taking into account the desired operating pressure, the flow path and volume of the organic solvent, and the number of heat exchanger tube bundles in the heat exchanger train 5. The pump 7 is preferably configured to convey the organic solvent through the closed system 6 at a predetermined operating pressure.

The pump 7 is fluidly connected to process equipment 8 that is in fluid communication with a first end of the heat exchanger train 5. For instance, suitable connection line 9 may be connected to the process equipment 8 at inlet port 10. The inlet port 10 is configured so that organic solvent flows into the process equipment 8 through the inlet port 10. The pump 7 is also fluidly connected with process equipment 8 that is in fluid communication with a second end of the heat exchanger train 5. For instance, suitable connection line 11 may be connected to the process equipment 8 at outlet port 12. The outlet port 12 is configured so that organic solvent flows out of the process equipment 8 through the outlet port after it has contacted the heat exchanger train 5. The inlet port 10 may be located either upstream or downstream of the heat exchanger train 5 with the outlet port 12 being located at the opposite end of the heat exchanger train. Depending on where the inlet port 10 and the outlet port 12 are located with respect to the associated process equipment 8, the closed system 6 may also include any amount of additional process equipment.

The inlet port 10 and outlet port 12 may be selected so as to place the organic solvent in fluid communication with either the shell side of a heat exchanger tube bundle 3 or the tube side of a heat exchanger tube bundle 4, depending on which side is meant to be treated. The method and system may be used to treat both portions of a heat exchanger tube bundle, either in sequence, i.e. by performing the treatment process a second time with the system connected to different inlet and outlet ports, or at the same time. In some embodiments, if both the shell side 3 and the tube side 4 of a heat exchanger tube bundle are to be cleaned at the same time, separate systems are connected to be in fluid communication with, and treat, each of the tube side and the shell side.

A source of organic solvent 13 is brought to the site where the heat exchanger train 5 is employed. The source of organic solvent 13 may comprise a tanker or a number of tanker trucks or any other solvent storage tank or tanks. The source of organic solvent 13 is brought into fluid connection with the closed system 6. As illustrated in FIG. 4A, the source of organic solvent 13 may be connected, by at least suitable connection line 14, to an inlet or inlet manifold 15, associated with pump 7. Through this connection, the closed system 6 may be filled with organic solvent and then the fluid connection between the organic solvent source 13 and the closed system is sealed. The fluid connection between the organic solvent source 13 and the closed system 6 may be sealed, for example, by a valve associated with the inlet manifold 15. Once the organic solvent source 13 has been sealed off from the closed system 6, the organic solvent may be circulated through the closed system 6 in a continuous flow, illustrated in FIG. 4B, until the cleaning process is completed, i.e. until the heat exchanger tube bundles 1 are substantially clean, or until the organic solvent in the closed system reaches saturation.

In some embodiments, the closed system 6 also includes a heater 16, configured to raise the temperature of the organic solvent to a preselected operating temperature. As illustrated in FIG. 5, the heater 16 may comprise a heating unit, for example, a heat exchanger. In another embodiment, the organic solvent may be brought to an operating temperature using a heater 16 that is part of the associated process equipment 8 that may be included within the closed system 6 by selection of the inlet port 10. If that is the case, then no additional heating unit may be required.

In some embodiments, the closed system 6 may also include a cooler 17. The cooler 17 is configured so that, at the completion of the treatment process, the organic solvent in the closed system 6 may be lowered to a safe handling temperature, i.e. a temperature below the flash point of the organic solvent, at which it can be conveyed out of the closed system 6 and, for example, back to the organic solvent source 13. The cooler 17 may comprise a cooling unit, such as an aerial cooler. If a heat exchanger is used as the heater 16, the organic solvent in the closed system 6 may be cooled simply by replacing the heating agent of the heat exchanger, such as steam or glycol, with a cooling agent, such as cooling water. If that is the case, then no additional cooling unit is required.

In some embodiments, the closed system 6 also comprises a filtration system 18 that is configured to remove solid contaminants from the organic solvent exiting the outlet port 12 prior to it reaching the pump 7. The filtration system 18 is thus prevents solids from passing into, and interfering with, the pump 7.

Figure 3:
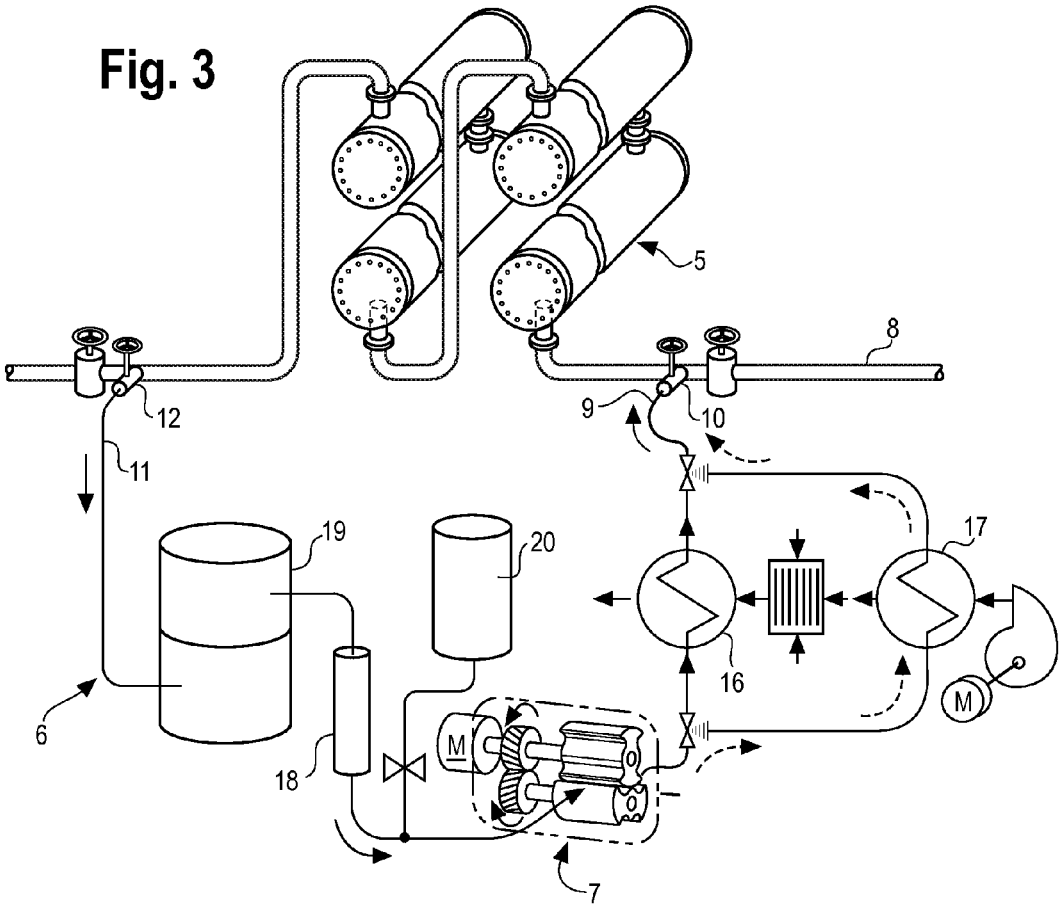
FIG. 3 is a combination flow diagram and perspective view of a closed system in accordance with an embodiment of the present invention.

In some embodiments, the closed system 6 also comprises a solvent capacity tank 19. The solvent capacity tank 19 comprises one or more vessels capable of withstanding the operating pressure. The solvent capacity tank 19 may be configured to serve a number of purposes. For example, the solvent capacity tank 19 may be used to ensure that closed system 6 has the capacity to circulate enough organic solvent to effectively clean the heat exchanger tube bundles 1 in the heat exchanger train 5 of carbonaceous deposits without reaching saturation. The solvent capacity tank 19 may also be used to separate and store contaminates, such as solid deposits that are carried out of the heat exchanger train 5 or hydrocarbon contaminates that may fall out of the organic solvent during its residency in the solvent capacity tank. This may be particularly advantageous toward the end of the treatment process, when the organic solvent might approach a level of suspended hydrocarbons at which the efficiency of the organic solvent to clean the heat exchanger tube bundles 1 becomes decreased. It may also be particularly advantageous where, for example, the level of carbonaceous deposits to be removed from the heat exchanger tube bundles 1 is particularly high. In some embodiments, such as illustrated in FIGS. 3-5, the solvent capacity tank 19 is located so as to accept the organic solvent as it exits the outlet port 12. Thus, in some embodiments, the organic solvent is conveyed through the solvent capacity tank 19 to pump 7, by which it is circulated back into contact with the heat exchanger tube bundles 1. If desired, the filtration system 18 and the solvent capacity tank 19 can be integrated into a single unit.

In some embodiments, the closed system 6 also includes an expansion chamber 20. The expansion chamber 20 may be configured to serve a number of functions. For instance, an expansion chamber 20 may be useful at the start-up and shut-down of the cleaning treatment process. As the organic solvent in the closed system 6 is initially brought to its operating temperature, it will expand. The expansion chamber 20 provides a vessel where an amount of organic solvent displaced due to the expansion can be conveyed. Similarly, as the organic solvent in the closed system 6 is cooled down at the end of the cleaning process, organic solvent in the expansion chamber 20 may be displaced back into the closed system. The expansion chamber 20 may also be utilized to release pressure spikes during the cleaning of the heat exchanger tube bundles 1, such as pressure that may quickly increase due to a blockage. The expansion chamber 20 may be blanketed with an inert gas, such as nitrogen.

In some embodiments, the expansion chamber 20 may also be fitted with a pressure safety valve. The pressure safety valve may be configured to activate at a predetermined point, such as a point approaching the capacity of the expansion chamber. Activation of the pressure safety valve would provide for fluid flow from the expansion chamber 20, through the pressure safety valve, and to a storage tank. The storage tank may be, for example, the source of the organic solvent 13.

In some embodiments, the system also may include a sensor or series of sensors that are configured to monitor the flow of organic solvent through the closed system 6. In many instances, it may be possible to use sensors that are already built into the process equipment 8. The sensors monitor the volume of flow and/or the pressure and relay that information to a control panel 22, where the system and process may be controlled by an operator or in a semi-automated mode. In some embodiments, the pump 7 is operable to increase or decrease the flow of organic solvent in direct response to pressure or flow changes detected by the sensors. The system may be configured so that the pump 7 only works as much as is necessary in order to maintain the desired flow of organic solvent through the closed system 6. In some embodiments, the system may also be configured such that the sensors are operable to identify a significant drop in pressure, should one occur, at which point an emergency shutdown of all pumps and valves may be implemented. This may occur, for example, were there to be a loss of containment, i.e. a leak in the closed system 6.

The system also may comprise an inert gas source. The inert gas source may be connected to the closed system 6 in order to test the operation of the closed system at high pressure prior to operation of the system with organic solvent. The inert gas source may be connected to the closed system using an independent inlet valve at the inlet port 10.

While not meant to be limiting, a process of removing carbonaceous deposits from a heat exchanger tube bundle 1 in accordance with an embodiment of the present invention is described below. In an embodiment of the present invention, an organic solvent is circulated through a closed system to contact the heat exchanger tube bundles 1 at a selected operating temperature and operating pressure that are effective for the removal of carbonaceous deposits.

Before the heat exchanger cleaning process is begun, the heat exchanger train 5 may be analyzed to determine, as best as possible, the extent and type of the carbonaceous deposits that need to be removed. From this information, one may be able to estimate the amount of organic solvent that will be needed to effectively clean the heat exchanger tube bundles 1 in the heat exchanger train 5. The amount of organic solvent that is brought to the site and entered into the closed system 6 is preferably at least the amount determined from the analysis and, more preferably, an amount in excess of that determined from the analysis. In this way, one may ensure that a sufficient amount of organic solvent is present in the closed system 6 to avoid reaching the saturation point of the solvent, which would require the treatment process to be shut down and started back up by filling the closed system with a new source of organic solvent. The closed system 6 is preferably configured to contain the desired amount of organic solvent. This may be accomplished, for example, by the selection of a closed system 6 containing a particular expanse of process equipment 8, as described below, and/or by the inclusion of an appropriately sized solvent capacity tank 19.

The selection of the inlet port 10 and outlet port 12 defines the expanse of process equipment 8 that is included in the closed system 6. In addition to factoring into the capacity of the closed system 6 regarding organic solvent, the expanse of process equipment 8 falling within the closed system may also determine the allowable operating pressure. Accordingly, the process equipment 8 may be analyzed to determine what operating pressure the various portions of process equipment may safely withstand. Because leaks are to be avoided, the weakest link of the process equipment 8 that falls within the closed system 6 will often determine the maximum operating pressure. The selection of the inlet port 10 and outlet port 12 may thus be based on the desire to maintain a particular operating pressure within the closed system 6.

The closed system 6 comprising the heat exchanger train 5 is then isolated from any associated plant equipment that is not meant to be included within the closed system. This may be achieved by using a valve or series of valves or through the use of one or more blanking devices.

Once the expanse of process equipment 8 falling within the closed system 6 is defined, the closed system may be pressure-tested in order to ensure that it will withstand the operating pressure to be utilized during the cleaning process. This pressure-testing may be performed by flowing an inert gas, such as nitrogen, or an appropriate liquid, such as water, through the closed system 6 at or above the selected operating pressure.

It also may be ensured that the temperature within the closed system 6 is below the flash point of the organic solvent before the solvent is introduced. The organic solvent source 13 is then connected to the inlet manifold 15 of pump 7 and organic solvent is supplied to the closed system 6. Preferably, the closed system 6 is completely filled with organic solvent. By filling the closed system 6 with organic solvent, any excess gas is removed, guaranteeing that no oxygen or other reactive gases remain in the closed system 6. Once the desired amount of organic solvent is conveyed into the closed system 6, the fluid connection between the organic solvent source 13 and the closed system 6 is sealed.

The organic solvent in the closed system 6 is then heated to the preselected operating temperature. During heating of the organic solvent, any overflow of solvent may be displaced into the expansion chamber 20 as previously described. The operating temperature may be selected based on a number of factors, including the effectiveness of the selected organic solvent at a particular temperature, the degree of fouling of the heat exchanger tube bundles, and the types of carbonaceous deposits to be removed from the heat exchanger tube bundle or bundles. Because the environment within the closed system 6 is carefully controlled, the operating temperature may be selected to be above the flash point of the organic solvent. Thus, for instance, when d-limonene is used as the organic solvent, the operating temperature may be as high as, for example, 150° C. For example, when d-limonene is used as the organic solvent, the operating temperature is selected to be between about 90° and 120° C., more preferably between about 90° and 105° C. It is to be understood that the preferred operating temperatures may vary depending on the organic solvent being used. Due to the controlled environment within the closed system 6, the organic solvent remains in liquid form throughout the process.

The organic solvent is pumped through the closed system 6 at a preselected operating pressure. The operating pressure is largely dependent on the capacity for the equipment making up the closed system 6 to operate safely at the selected pressure. Preferably, the operating pressure is selected to be at or near the maximum pressure that can be utilized while maintaining the safe operation of the closed system. Typical operating pressures range between about 150 and about 400 psi.

The system is configured to maintain a flow of organic solvent through the closed system 6 at the operating pressure. In order to maintain a flow of organic solvent at the operating pressure, the system may be configured to adjust to various pressure changes within the closed system 6. Pressure changes will be detected, for example, by sensors that may be located at various points along the closed system 6. For instance, if the pressure within the closed system 6 raises, such as may occur due to a blockage caused by heavy carbonaceous deposits, the pump 7 will decrease the flow rate of organic solvent and/or the increased pressure will be relieved by way of the expansion chamber 20. Similarly, if the pressure within the closed system 6 drops, as may occur due to the removal of a blockage, the flow rate of organic solvent will be increased until the operating pressure is again maintained. In some embodiments, the system may be fully automated so that the pump 7 will respond directly to pressure changes that are detected within the closed system 6. In this way, the treatment process may be carried out at maximum efficiency.

Figure 6A:
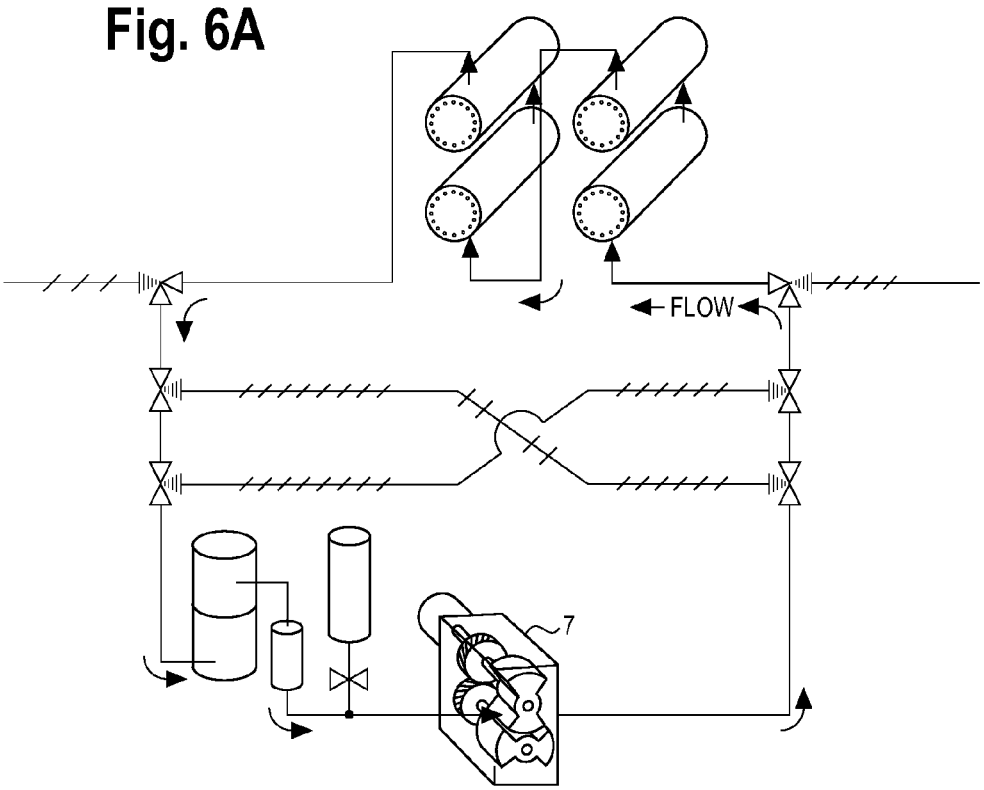
FIG. 6A is a flow diagram of a valve system operable to reverse the solvent flow through a closed system in accordance with an embodiment of the present invention, configured for forward flow.
Figure 6B:
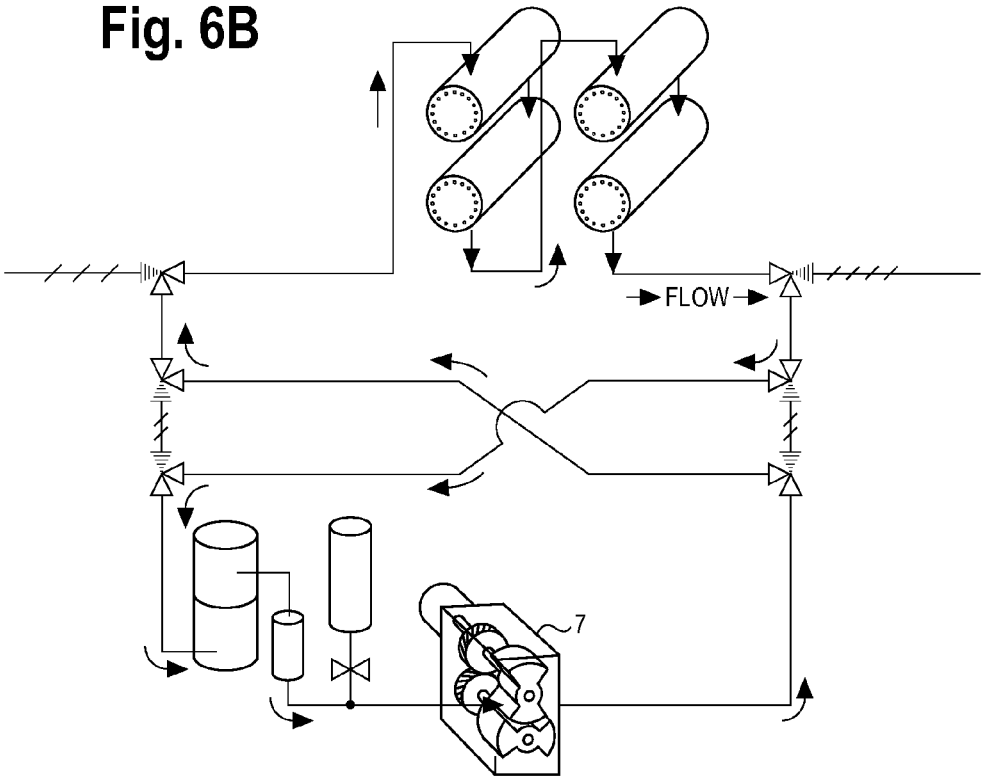
FIG. 6B is a flow diagram of a valve system operable to reverse the solvent flow through a closed system in accordance with an embodiment of the present invention, configured for reverse flow.

Blockages of solid carbonaceous deposits may be dealt with in a number of ways. For example, a hydrosonic pulse, or shockwave, may be created to aid in the dislodgement or breakdown of a blockage. A shockwave can be created by quickly stopping and releasing the flow of organic solvent in such a way as to create a series of static loads. Each static load brings about a fraction of second where the blockage experiences no load followed by a fraction of a second where the blockage experiences a hard load. This repeated battering of the blockage with hard loads of organic solvent aids in the dislodgement or breakdown of the blockage. The shockwave can be created, for example, by the use of a quick on and off valve, such as may be located as the organic solvent enters inlet port 10. Alternatively, the flow of the organic solvent can be reversed and then returned to its original flow direction. This can be achieved by re-directing the flow into and from the pump 7 using a system of valves, as illustrated in FIG. 6A, which shows a valve system configured for forward flow and FIG. 6B, which shows a valve system configured for reverse flow. The reversing of the flow in this manner can be performed in a fraction of a second in order to create a series of loads that act on a both sides of a blockage to help breakdown the blockage.

The contaminated organic solvent exiting outlet port 12 is conveyed back to pump 7, where it is re-circulated to contact the heat exchanger tube bundles 1 in a continuous flow until the treatment process is complete or, less desirably, the organic solvent has reached a level of suspended hydrocarbons at which the organic solvent is no longer effective. The level of suspended hydrocarbons at which a particular organic solvent is deemed no longer efficient will depend on the ability of that organic solvent to continue to solubilize hydrocarbons. This may be determined by analyzing the effectiveness of the organic solvent at various levels of saturation. For example, d-limonene can reach saturation levels of up to about 30% by weight hydrocarbons. However, when the suspended hydrocarbon content of the d-limonene solvent reach about 20% by weight, its effectiveness in solubilizing hydrocarbons decreases to the point where it may no longer be efficient to use for removing carbonaceous deposits.

As noted above, in some embodiments, the amount of organic solvent within the closed system 6 is preferably selected such that the organic solvent does not reach a level of suspended hydrocarbons at which it is no longer effective. In this way, the treatment process may be performed without having to evacuate the contaminated organic solvent and re-fill the closed system 6 with fresh organic solvent. If the number of heat exchanger tube bundles 1 to be treated is very high and/or if the level of carbonaceous deposits is very high, however, it may be necessary to run the treatment process until the organic solvent in the closed system is no longer effective and then replace that contaminated organic solvent with a fresh organic solvent source 13.

In some embodiments, the organic solvent exiting outlet port 12 may also be conveyed into a solvent capacity tank 19 and/or a filtration system 18 prior to being conveyed to pump 7. In this way, contaminants and/or loosely suspended hydrocarbons may be separated from the organic solvent before it is re-circulated to contact the heat exchanger tube bundles 1.

The cleaning process is preferably run until the heat exchanger tube bundles 1 are substantially cleaned of carbonaceous deposits. Preferably, greater than 85% of deposits are removed from the heat exchanger tube bundles. More preferably, greater than 90% of deposits are removed from the heat exchanger tube bundles. Even more preferably, greater than 95% of deposits are removed from the heat exchanger tube bundles. Once the removal of carbonaceous deposits is deemed to be substantially complete, the organic solvent in the closed system 6 is cooled to a temperature below its flash point. Once it has reached a safe handling temperature, fluid communication between the organic solvent source 13 and the closed system 6 is re-established and the organic solvent is conveyed out of the closed system and back to the organic solvent source. The organic solvent can then be transported off-site for solvent recovery.

The organic solvent to be used for cleaning a heat exchanger tube bundle 1 in accordance with the present invention may be specifically selected based on the properties of the organic solvent and the profile of contaminants on the bundles being treated. Preferred properties of the organic solvent include the capacity to effectively remove heavy hydrocarbons and bitumen, the ability to solubilize hydrocarbons, a high saturation point with respect to hydrocarbons, and the capacity to be efficiently and cost-effectively separated from suspended hydrocarbons by distillation.

D-limonene is an exemplary organic solvent for embodiments of the present invention. D-limonene is a terpene that can reach saturation levels of hydrocarbons up to about 30% by weight and can be easily be distilled to recover over 98% of the d-limonene. In general, organic solvents that are considered to have a desirable combination of properties may be selected from the following: alkylated aromatics (including alkylates), aliphatic hydrocarbons, unsaturated hydrocarbons (such as olefinic hydrocarbons and cyclic hydrocarbons), esters (including aromatic esters, fatty esters, and other unsaturated esters), ethers (including aromatic ethers, fatty ethers, and other unsaturated ethers), halogenated hydrocarbons, heterocyclic hydrocarbons, heteroatom containing hydrocarbons, and combinations thereof. By selecting an organic solvent that is customized for treatment of a particular contaminant profile, the present invention provides a method that can be specifically tailored to provide maximum efficiency at the lowest cost.

In an embodiment of the present invention, the contaminated organic solvent is reclaimed in an organic solvent recovery process, such as that described in U.S. application Ser. No. 13/414,177, incorporated in its entirety herein by reference. The reclaimed organic solvent may then be reused for the cleaning of a heat exchanger tube bundle, such as using the process described herein.

Figure 7:
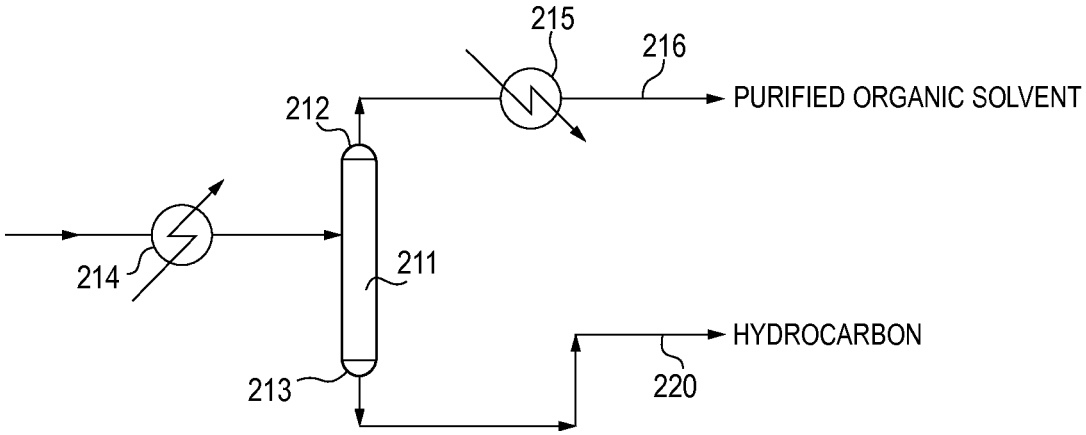
FIG. 7 is a flow diagram of an embodiment of a distillation unit, configured for the separation of suspended hydrocarbons from organic solvent, such as that used in a system for the recovery of organic solvent.

For recovery, the contaminated organic solvent may be transported to a treatment center where it is fed into a distillation unit 210. In the distillation unit 210, the more volatile organic solvent is boiled off and separated from the less volatile suspended hydrocarbons. In the distillation column 211, the organic solvent containing suspended hydrocarbons is heated to a temperature at which the organic solvent is boiled off and separated from the hydrocarbon contaminants. The purified organic solvent coming off the top of the distillation column 212 is then recaptured by condensing 215 it back to its liquid form. By control of the distillation process, the organic solvent exiting the distillation unit 210 can be rendered substantially free of suspended hydrocarbons. This purified organic solvent may then be reused in the bundle cleaning process. An example of the distillation process is illustrated in FIG. 7.

The amount of purified organic solvent recovered from the distillation process depends on the properties of the particular organic solvent being used. For example, when d-limonene is used as the organic solvent, at least 98% of the d-limonene is recovered from a single pass through the distillation column 211. The remaining 2%, which remains bonded to hydrocarbons, could be separated by additional passes through the distillation column 211; however, because of the minimal return, it is not efficient to do so. Other organic solvents may be more difficult to separate from the suspended hydrocarbons. Thus, depending on the organic solvent selected, it may be desirable to pass the contaminated organic solvent through the distillation column 211 multiple times in order to recover a desirable amount of purified organic solvent.

Preferably, at least 90% of the organic solvent fed into the distillation process is recovered as a purified organic solvent. More preferably at least 95% of the organic solvent is recovered from the distillation process as a purified organic solvent. Most preferably, at least 98% of the organic solvent is recovered from the distillation process as a purified organic solvent. This purified organic solvent may again be used for the in-situ cleaning of heat exchanger tube bundles.

Some of the organic solvents may comprise a number of different organic constituents, each of which may separate from the suspended hydrocarbons in the distillation column 211 to different degrees. The result may be a purified organic solvent having a composition that differs somewhat from the originally selected organic solvent. Accordingly, in some embodiments, it will be desirable to blend the purified organic solvent exiting the distillation column 211 with fresh amounts of one or more of the particular constituents of the original organic solvent in order to more closely match the composition of the purified organic solvent with the composition of the originally selected organic solvent.

In another embodiment of the solvent recovery process, a mixture of hydrocarbons is separately collected as the bottoms of the distillation process 213. Typically, because some amount of organic solvent remains bonded to the hydrocarbons that are collected as the bottoms of the distillation process 213, the viscosity of this mixture is lowered. Additionally, because the organic solvent does not include chemicals such as surfactants and the like, the organic solvent that remains in the bottoms need not be separated from the hydrocarbons to be put through a refining process. Accordingly, the hydrocarbon stream collected from the distillation process 213, or at least a large portion thereof, may itself be used as refinable oil.

In some embodiments, the hydrocarbon stream collected from the bottoms of the distillation process is separated into light and heavy fractions. The light fractions of the hydrocarbon stream may be collected to produce an enhanced recovery oil product. This separation may be performed by allowing the mixture to separate by gravity, such as by settling in an enhanced recovery oil tank. Although the heavier fractions may need to be disposed, the lighter oils that rise to the top of the enhanced oil recovery tank may be collected and used for further refinement. As these useful oils may typically constitute greater than ninety-five percent of the hydrocarbon mixture, this process can yield a significant amount of useful enhanced recovery oil. As such, hydrocarbon waste may be greatly reduced.

In some embodiments of the organic solvent recovery process, contaminated organic solvent is separated from solids and/or base waters before being fed into the distillation unit. Contaminated organic solvent used in a heat exchanger tube bundle cleaning process typically contains an amount of solids comprising carbonaceous deposits that either were not suspended in the organic solvent or did not remain suspended in the organic solvent. Additionally, many of the carbonaceous deposits typically found on heat exchanger tube bundles include encapsulated water molecules. Therefore, when the deposits soften and/or become suspended in the organic solvent, these base waters are released. Accordingly, contaminated organic solvent will often contain water molecules known as base waters. It is desirable to remove solids and/or base waters before the contaminated organic solvent is sent to a distillation unit to separate the solvent from the suspended hydrocarbons.

By using an organic solvent that is less dense than water (i.e. the organic solvent has a specific gravity of less than one), the contaminated organic solvent, when allowed to settle, will separate from base waters. More specifically, the water will drop to the bottom and the less dense organic solvent will rise to the top. Additionally, over time, solids will also settle out of the organic solvent and drop to the bottom. Accordingly, the contaminated organic solvent may be separated from solids and/or base waters by allowing the mixture to separate and collecting only the top portions, which are substantially free of solids and base waters. Preferably, the separation process is performed until the organic solvent contains less than 10% water. More preferably, the separation process is performed until the organic solvent contains less than 2% water.

Figure 8:
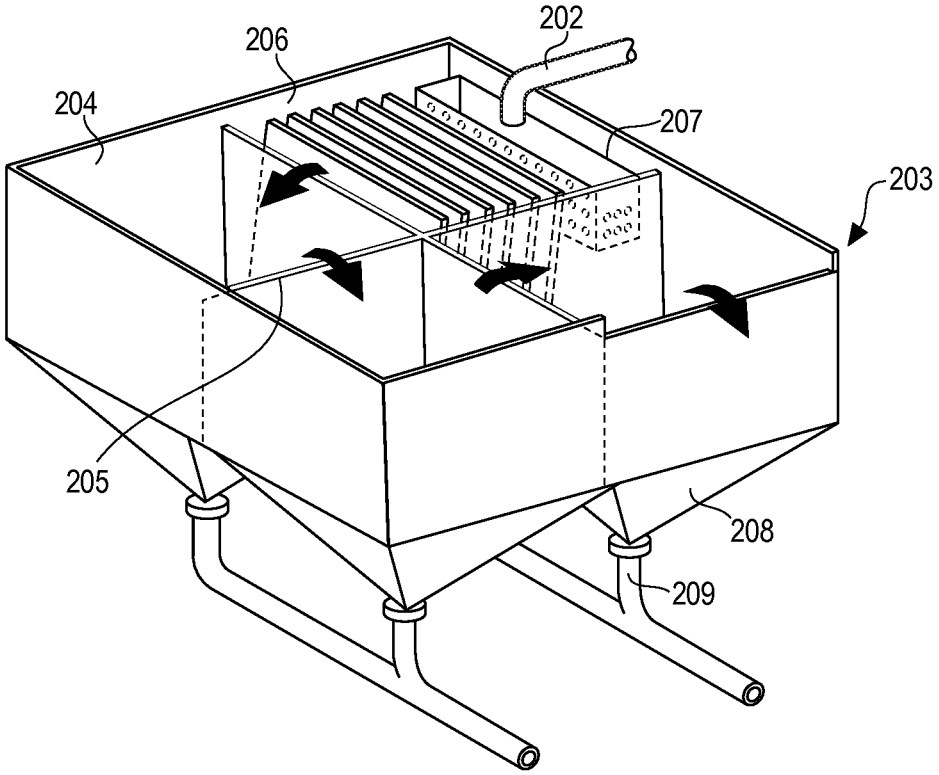
FIG. 8 is a perspective view of an embodiment of a separation unit, configured for the separation of solids and base waters from organic solvent, such as that used a system for the recovery of organic solvent.

Because the separation of an organic solvent from solids and/or base waters can be a time-consuming process, the separation may be controlled and sped up through the use of multiple separation tanks, arranged in series. An example of this system is illustrated in FIG. 8. By configuring the separation tanks 204 so that only the top portion of the organic solvent flows from one tank into the next, such as by forcing the solvent to flow over a weir 205, the solvent in each downstream separation tank 204 contain less base waters and/or solids than the solvent in the previous tank. The use of several separation tanks 204 provides for a continuous separation of the organic solvent from solids and base waters. As contaminated organic solvent is introduced into one end of each separation tank 204, organic solvent containing a lower amount of solids and/or base waters is removed from the other end, so that the solvent level of the tank is kept at a constant. In some embodiments, the contaminated organic solvent enters the first separation tank 204 through a diffuser 207, which breaks up the flow of the solvent, thereby providing a slow diffusion of the solvent into the tank, and a more stable settling time.

The separation may be further controlled and sped up through the use of a series of knock-out plates 206. The knock-out plates 206 may be contained in one or more of the separation tanks 204 through which the organic solvent is passed. As the solvent in a tank 204 slowly moves downstream, it must pass through the series of knock-out plates 206, each of which allows the lighter organic solvent to flow over the top of each knock-out plate at a higher rate than the heavier base waters and/or solids. Thus, as the organic solvent progresses over the series of knock-out plates 206, it is continuously separated from solids and/or base waters. In some embodiments, the knock-out plates 206 are set at a slight grade, such as about ten degrees, with the top of each plate being slightly further upstream than the bottom. This forces the solids and/or waters to fall out in a downstream direction, increasing the effectiveness of the separation. The knock-out plates 206 may also be spaced apart in even increments to provide maximum efficiency.

In some embodiments, each of the one or more separation tanks 204 also has a cone-shaped bottom 208. The cone-shaped bottom 208 operates to direct the solids and waters to an opening at the bottom of the cone from which they may easily be removed from the tank 204, such as through a suction pipe 209.

In some embodiments, the contaminated organic solvent may be separated from solids and base waters by the system illustrated in FIG. 8. This process involves a first treatment in a separation tank 204 having a series of knock-out plates 206. This first treatment removes a large percentage of the solids. Then, the organic solvent is further separated from solids and base waters by its passage through a series of additional separation tanks 204. When d-limonene is used as the organic solvent, for example, up to 2,000 liters per minute may typically be treated using this separation process to yield a product that contains less than 2% base waters.

This same process may typically be used to achieve a desired separation for any of the organic solvents. For example, an organic solvent having a density closer to that of water (i.e. a specific gravity close to one) will require a longer time to separate. To ensure a desired degree of separation with a denser organic solvent, therefore, one would simply lower the flow rate of the solvent through the separation process. If a slower flow rate alone would not provide the desired degree of separation, or if a slower flow rate was undesirable, one could increase the number of knock-out plates 206 and/or the size or number of separation tanks 204 in order to achieve a desired flow rate of a product having a desired purity.

It can be seen that the described embodiments provide unique and novel methods and systems for the in-situ removal of hydrocarbon deposits from a heat exchanger tube bundle that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A method for the in-situ treatment of a heat exchanger tube bundle to remove carbonaceous deposits, said method comprising a. analyzing the heat exchanger tube bundle to determine an amount of organic solvent necessary to effectively remove the carbonaceous deposits from the heat exchanger tube bundle without the organic solvent reaching its saturation point;

b. providing a source of organic solvent;

c. creating a closed system wherein the organic solvent is in fluid communication with the heat exchanger tube bundle, the closed system being configured so that a volume of the closed system is sufficient to prevent the organic solvent from reaching its saturation point;

d. bringing the organic solvent to a temperature at which it is effective to remove carbonaceous deposits from the heat exchanger tube bundle; and e. contacting the heat exchanger tube bundle with the organic solvent to remove carbonaceous deposits from the heat exchanger tube bundle, resulting in a contaminated organic solvent comprising soluble hydrocarbons; and f. recovering the organic solvent, the recovery comprising treating the contaminated organic solvent to remove soluble hydrocarbons;

wherein the heat exchanger tube bundle is not removed from its associated process equipment during treatment.

2. The method of claim 1 wherein the heat exchanger tube bundle is part of a heat exchanger train and the organic solvent is flowed through the heat exchanger train to remove carbonaceous deposits from each heat exchanger tube bundle therein.

3. The method of claim 1, wherein the organic solvent comprises d-limonene.

4. The method of claim 1 wherein the source of organic solvent comprises one or more tanker trucks.

5. The method of claim 1 further comprising maintaining the pressure in the closed system at about a pre-selected operating pressure.

6. The method of claim 1, further comprising sending a hydrosonic pulse through the solvent to dislodge a carbonaceous deposit.

7. The method of claim 1, further comprising reversing the flow of organic solvent to breakdown the carbonaceous deposits.

8. The method of claim 1, wherein the organic solvent is continuously circulated through the closed system.

9. The method of claim 1, wherein treating the contaminated organic solvent to remove soluble hydrocarbons comprises distilling the contaminated organic solvent to produce a purified organic solvent fraction and a hydrocarbon fraction.

10. The method of claim 1, wherein the temperature at which the organic solvent is effective to remove carbonaceous deposits from the heat exchanger tube bundle is above the flash point of the organic solvent.

11. The method of claim 1, wherein the closed system includes a solvent capacity tank that is sufficient to provide a desired volume.

12. The method of claim 5 wherein the maintenance of the pressure at a pre-selected operating pressure is performed by adjusting the flow of solvent in response to pressure changes within the closed system.

13. The method of claim 9, wherein recovering the contaminated organic solvent also comprises separating solids and base waters prior to distilling the contaminated organic solvent.

14. The method of claim 12 wherein the maintenance of the pressure at about a pre-selected operating pressure is performed automatically.

* * * * *